US012540515B2

(12) United States Patent
Moss et al.

(10) Patent No.: US 12,540,515 B2
(45) Date of Patent: Feb. 3, 2026

(54) EXTENDED RANGE SPIDER

(71) Applicant: Frank's International, LLC, Houston, TX (US)

(72) Inventors: Alfred Moss, Lafayette, LA (US); Logan Essex Smith, Lafayette, LA (US); Jeremy Richard Angelle, Youngsville, LA (US); Robert L. Thibodeaux, Jr., Lafayette, LA (US); Neil Alleman, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 19/026,857

(22) Filed: Jan. 17, 2025

(65) Prior Publication Data

US 2025/0257618 A1 Aug. 14, 2025

Related U.S. Application Data

(60) Provisional application No. 63/551,822, filed on Feb. 9, 2024.

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/102; E21B 19/07
See application file for complete search history.

(56) References Cited

U.S. PATENT DOCUMENTS

| | | | | |
|---|---|---|---|---|
| 2,068,217 | A * | 1/1937 | Abegg | E21B 19/10 188/67 |
| 3,742,562 | A * | 7/1973 | Haby | E21B 19/07 188/67 |
| 7,267,168 | B1 | 9/2007 | Sipos | |
| 7,395,855 | B2 * | 7/2008 | Ayling | E21B 19/10 188/67 |
| 7,926,577 | B2 * | 4/2011 | Thomas | E21B 19/10 166/380 |
| 2009/0056930 | A1 * | 3/2009 | Angelle | E21B 19/24 166/77.51 |

(Continued)

OTHER PUBLICATIONS

Combined Search and Examination Report dated May 24, 2025, GB Application No. GB2501022.4, 7 pages.

*Primary Examiner* — Blake Michener
(74) *Attorney, Agent, or Firm* — MH2 Technology Law Group, LLP

(57) ABSTRACT

An apparatus for supporting an oilfield tubular includes a body defining a tapered bowl and a pocket formed in the body, a cage extending axially through the body, wherein guides are attached to the cage, a slips assembly including slips configured to engage a tubular received in the body. The slips extend radially through the cage and engage the guides, and are movable between a retracted configuration in which the slips are received at least partially within the pocket and an extended position in which the slips slide against the tapered bowl. The apparatus also includes a lifting assembly coupled to the slips and configured to apply a linear, axially-directed force to the slips. The slips are guided to move radially and axially in response to the linear, axially-directed force by the guides.

20 Claims, 10 Drawing Sheets

(56) References Cited

U.S. PATENT DOCUMENTS

| | | | | |
|---|---|---|---|---|
| 2009/0057032 | A1* | 3/2009 | Angelle | E21B 19/24 166/77.52 |
| 2010/0116558 | A1 | 5/2010 | Angelle et al. | |
| 2018/0087333 | A1 | 3/2018 | Bouligny et al. | |
| 2020/0332608 | A1* | 10/2020 | Biggerstaff | E21B 19/10 |
| 2023/0095156 | A1* | 3/2023 | Biggerstaff | E21B 19/10 294/102.2 |

* cited by examiner

EXTENDED RANGE SPIDER

CROSS-REFERENCE TO RELATED APPLICATIONS

This patent application claims priority to U.S. Provisional Patent Application No. 63/551,822, filed on Feb. 9, 2024, which is incorporated by reference.

BACKGROUND

Spiders are tubular gripping devices that are used in some drilling rigs in the oilfield. Generally, casing, drill pipe, or another "add-on" tubular (e.g., a stand of two or more pipe joints that are threaded together) is suspended from an elevator or another device that lifts the tubular into place above a string of previously-run tubulars. The add-on tubular is then threaded into and thereby secured to the previously-run tubular string, such that it becomes part of the tubular string. The tubular string is then lowered into the well (which may or may not involve advancing a drill bit, float equipment, and/or other equipment, depending on the application) and the process is repeated.

While the add-on tubular is being secured to the previously-run string, the string is supported at or near the drill floor. One device that may be used to support the string is a "spider." The spider may provide "slips" or other tubular-engaging members. These tubular-engaging devices transfer the weight of the string to the spider, which in turn transfers the weight to the rig floor. Generally, a spider can be engaged or disengaged, e.g., by actuating hydraulic cylinders to lift or press down on the slips, driving them into engagement with the tubular or retracting them away from the tubular. Thus, the spider can be used with the elevator to hand-off the weight of the string when the string is able to be supported from the elevator via the add-on tubular, and then re-engage and support the string when the elevator has lowered the add-on tubular into the well.

Spiders generally operate with a limited range of tubular diameters. That is, the slips are limited as to how far they may travel radially to retract or engage. Thus, a given spider configuration may operate for a certain range of tubular sizes, and if a differently sized tubular is to be gripped, the spider may need to be reconfigured or switched out. Reconfiguration may include changing out the slips and/or inserts for a different size of slips/inserts, and this process is time consuming. Further, there may be instances where tools, collars, etc., generally members with larger outer diameters than the nominal diameter of the tubular string, are to be run into the well, through the spider. The spider is constrained by its inner diameter and may not easily admit such larger members to pass through, and may thus need to be temporarily removed or otherwise reconfigured. Such reconfiguration processes can represent non-productive time for the drilling rig.

SUMMARY

An apparatus for supporting an oilfield tubular includes a body defining a tapered bowl and a pocket formed in the body, a cage extending axially through the body, wherein guides are attached to the cage, a slips assembly including slips configured to engage a tubular received in the body. The slips extend radially through the cage and engage the guides, and are movable between a retracted configuration in which the slips are received at least partially within the pocket and an extended position in which the slips slide against the tapered bowl. The apparatus also includes a lifting assembly coupled to the slips and configured to apply a linear, axially-directed force to the slips. The slips are guided to move radially and axially in response to the linear, axially-directed force by the guides.

In another embodiment, the apparatus includes a body defining a tapered bowl and a pocket. The body defines two or more fast-tapered surfaces that intersect the tapered bowl. The apparatus also includes a cage extending axially through the body. The cage includes a plurality of axially-extending rails disposed at angular intervals. A plurality of guides are attached to the cage. The apparatus also includes a slips assembly including a plurality of slips that are configured to engage the oilfield tubular when the oilfield tubular is received in the body. The slips extend radially through the cage and engage the guides. The slips are positioned between circumferentially adjacent rails of the plurality of axially-extending rails. The slips are movable between a retracted position in which the slips are received at least partially within the pocket and an extended position in which the slips slide against the tapered bowl. The slips each include two or more fast-tapered surfaces configured to engage the fast-tapered surfaces of the body. The slips also each include a primary tapered surface configured to engage the tapered bowl. The slips define a groove configured to receive a guide feature of at least one of the guides. The guide feature received into the groove constrains movement of the slips. The groove has a first portion that facilitates movement of the slips along the tapered bowl, and a second portion that facilitates movement of the slips primarily radially into the pocket. The apparatus also includes a lifting assembly coupled to the slips and configured to apply a linear, axially-directed force to the slips. The guides cause the slips to move radially and axially in response to the linear, axially-directed force. The lifting assembly includes a plurality of cylinders coupled to a timing ring that is connected to the slips. The slips are coupled to the timing ring via a radially-extending slot. The cylinders are at least partially received into the body and through the timing ring. The cylinders are configured to press the timing ring toward the body by extending. The cylinders extend through the timing ring and are configured to pull the timing ring away from the body by compressing. The lifting assembly also includes a cover coupled to the body and defining a top opening therethrough. The cylinders are coupled to the cover, such that extending the cylinders drives the timing ring away from the cover.

A method for supporting an oilfield tubular is also disclosed. The method includes receiving the oilfield tubular into a body. The body defines a tapered bowl and a pocket. A cage extends axially through the body. Guides are attached to the cage. The method also includes engaging the oilfield tubular with a slips assembly. The slips assembly includes slips that extend radially through the cage and engage the guides. The method also includes actuating the slips between a retracted position and an extended position. The slips are received at least partially within the pocket in the retracted position, and the slips slide against the tapered bowl in the extended position. The method also includes applying a linear, axially-directed force to the slips using a lifting assembly. The lifting assembly is coupled to the slips. The guides cause the slips to move radially and axially in response to the linear, axially-directed force.

The foregoing summary is intended merely to introduce a subset of the features more fully described in the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
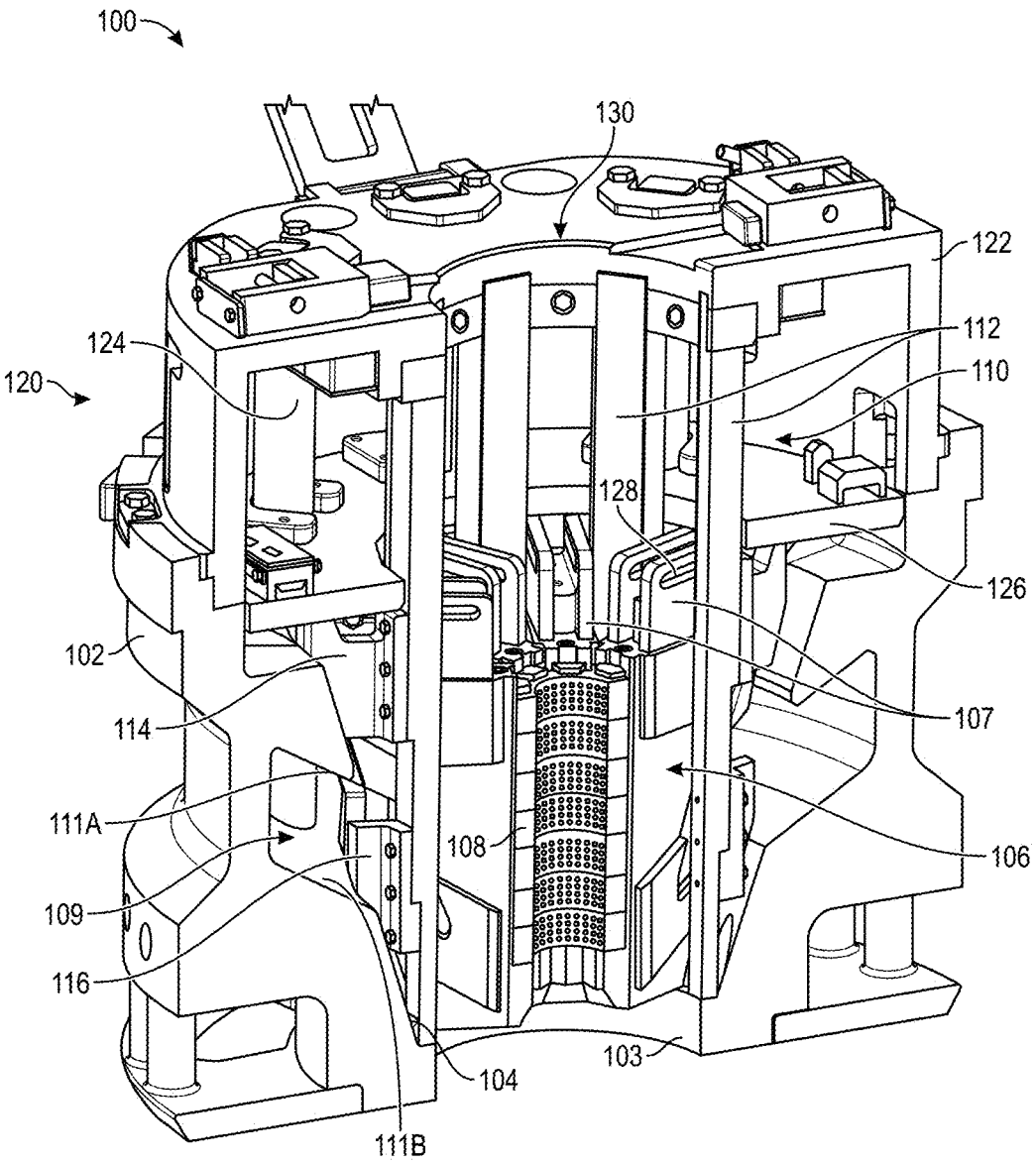
FIG. 1 illustrates a perspective, sectional view of a spider in an engaging position, according to an example.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

FIG. 1 illustrates a perspective, sectional view of a spider 100 in an engaging position, according to an embodiment. The spider 100 is an example of an apparatus that is configured to support an oilfield tubular (e.g., casing, liner, drill pipe, etc.), generally at or near a rig floor. The spider 100 generally includes a spider body 102. The spider body 102 may define an opening 103 therethrough and a tapered inner surface or "bowl" 104. A slips assembly 106 including several slips 107 may be positioned in the spider body 102. The slips 107 may be generally arcuate segments that can slide axially, as well as radially inward and outward, relative to the spider body 102 and move circumferentially closer together or farther apart.

The spider body 102 may also include a pocket 109, into which the slips 107 may be drawn when retracted, as will be described in greater detail below. The pocket 109 may be at least partially defined by fast-tapered surfaces 111A, 111B that intersect and extend outward from the tapered bowl 104. The fast-tapered surfaces 111A, 111B may be tapered to a greater angle, relative to an axial centerline, than the tapered bowl 104. These fast-tapered surfaces 111A, 111B are referred to as "fast" because their taper angle results in the slips 107 moving radially outward over a short axial distance, as compared to the slips 107 riding along the tapered bowl 104. In at least some examples, the fast-tapered surfaces 111A, 111B may extend parallel to one another.

An insert 108 may be coupled to the radial inside of the slips assembly 106 and may be configured to engage a tubular extending through the spider 100. The insert 108 may provide teeth, wickers, high-friction surfaces, or other gripping features for engaging the tubular.

The slips assembly 106 may extend through and be movable radially and axially with respect to a cage 110. As shown in the engaging position of FIG. 1, the slips 107 may extend through and inward of the cage 110. In a retracted position, discussed below, the slips 107 may be positioned radially outward of the cage 110. The cage 110 may be stationary with respect to the spider body 102, and the slips 107 may move with respect to both the spider body 102 and the cage 110. In a specific example, the cage 110 may include bars 112 that extend axially within the spider 100. The bars 112 may be separated apart at angular intervals so as to provide space for the slips 107 to move therethrough. Slips guide members, e.g., upper and lower guide members 114, 116, may be coupled to the cage 110 and may provide ridges, rails, rollers, grooves, or other guiding features for engagement with the slips 107. The guide members 114, 116 may be stationary with respect to and fixed to the bars 112 of the cage 110. The guide members 114, 116 may also extend radially outward from the cage 110.

The spider 100 may also include a lifting assembly 120. The lifting assembly 120 includes a cover 122, two or more actuators 124, and a timing ring 126. The cover 122 may be coupled to and extend upward from the spider body 102. The actuators 124 may be at least partially recessed into the spider body 102, e.g., positioned radially adjacent to the tapered bowl 104, e.g., rather than extending upward through the cover 122. The actuators 124 may be coupled with the cover 122. The actuators 124 may be configured to raise/lower the timing ring 126, such that the timing ring moves between the cover 122 and spider body 102.

The timing ring 126 may be coupled to the slips 107 via a radially-extending slot 128 formed in the slips 107, which permits a range of radial positions of the slips 107 relative to the timing ring 126. The cover 122 may also form an opening 130 through which a tubular may be received. In at least some embodiments, the cage 110 may be coupled to the cover 122 and extend through the timing ring 126, as shown.

Figure 2:
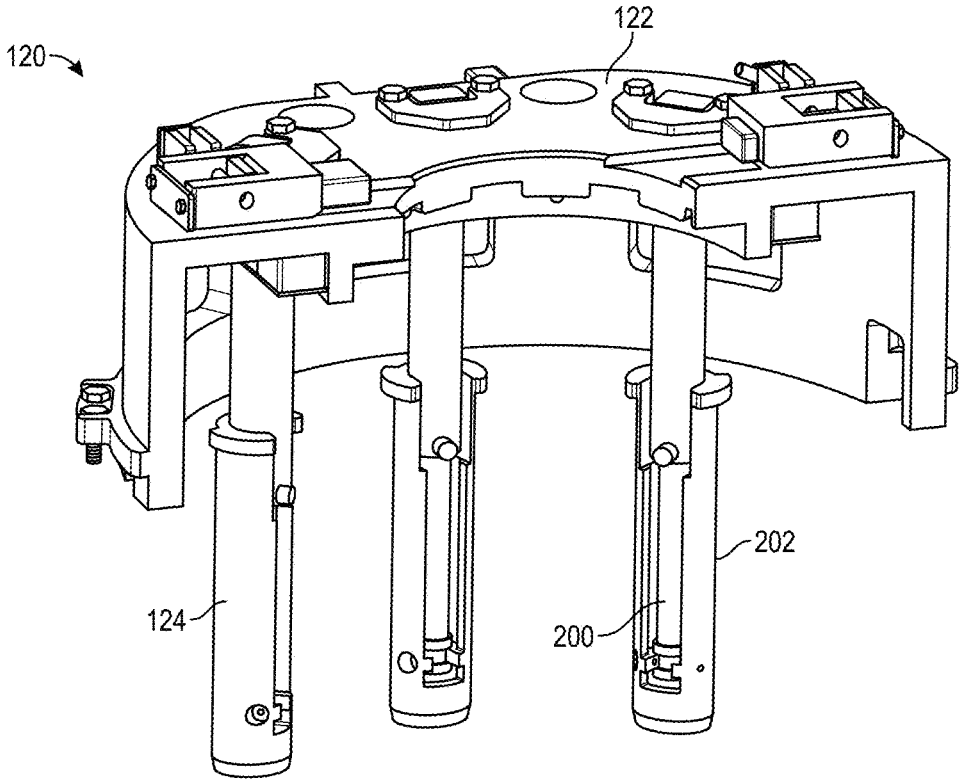
FIG. 2 illustrates a perspective, sectional view of a lifting assembly of the spider, according to an example.

FIG. 2 illustrates a perspective, sectional view of the lifting assembly 120, according to an example. The lifting assembly 120, as noted above, includes the cover 122 and the actuators 124. The actuators 124 may extend through the timing ring 126 (FIG. 1) and be received at least partially into the spider body 102 (FIG. 1). For example, as shown, the actuators 124 may include cylindrical guides 200 in which an extensible hydraulic cylinder 202 (or any other kind of cylinder or other actuator) is at least partially positioned. One end of the cylinder 202 may be coupled to the bottom of the cylindrical guide 200, while the other end may be coupled to the cover 122.

As noted above with reference to FIG. 1, the cover 122 may be coupled to the spider body 102, and may generally not be displaceable therefrom by operation of the cylinder 202. The cylindrical guides 200, which may be received into holes formed in the spider body 102, may be permitted a range of linear motion therein. Accordingly, extending the hydraulic cylinder 202 may push cylindrical guide 200 away from the cover 122.

Figure 3:
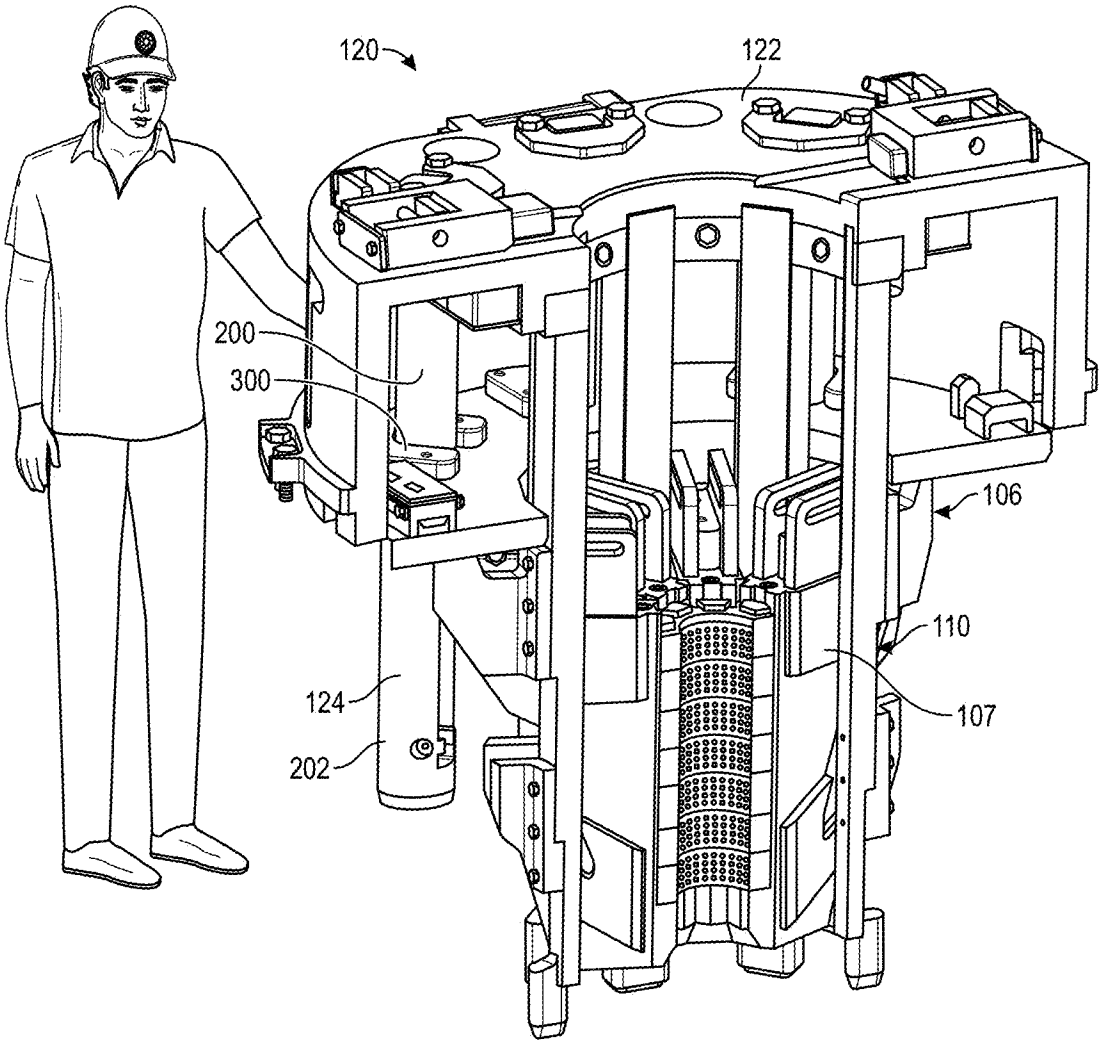
FIG. 3 illustrates a perspective, sectional view of the lifting assembly engaging a slips assembly via a timing ring of the spider, according to an example.

Referring now to FIG. 3, there is shown an additional, perspective, sectional view of the lifting assembly 120, now shown coupled to the cage 110 and the slips assembly 106, according to an example. As shown, the cylindrical guide 200 may be coupled to the timing ring 126. In particular, collars 300 may be provided that couple the cylindrical guide 200 to the timing ring 126. Accordingly, pushing the cylindrical guide 200 away from the cover 122 drives the timing ring 126 downwards. Further, retracting the cylinder 202 may draw the cylindrical guide 200, and thus the timing ring 126, toward the cover 122. The timing ring 126 is coupled to the slips assembly 106, such that axial (upward/downward) movement of the timing ring 126 relative to the spider body 102 results in both axial and radial (inward/outward) movement of the slips 107 of the slips assembly 106. The orientation of the actuators 124 may be such that the timing ring 126 is driven downward (toward the spider body 102) by extension of the cylinders 202. As such, the extension of the cylinders 202 may cause the slips 107 to engage the tubular. Such extension may provide for greater gripping force than would retraction movement of the cylinder 202. Further, the length of the cylinder 202 that is provided for the stroke is at least partially within the spider body 102, and thus the overall height of the spider 100 may be conserved.

Figure 4:
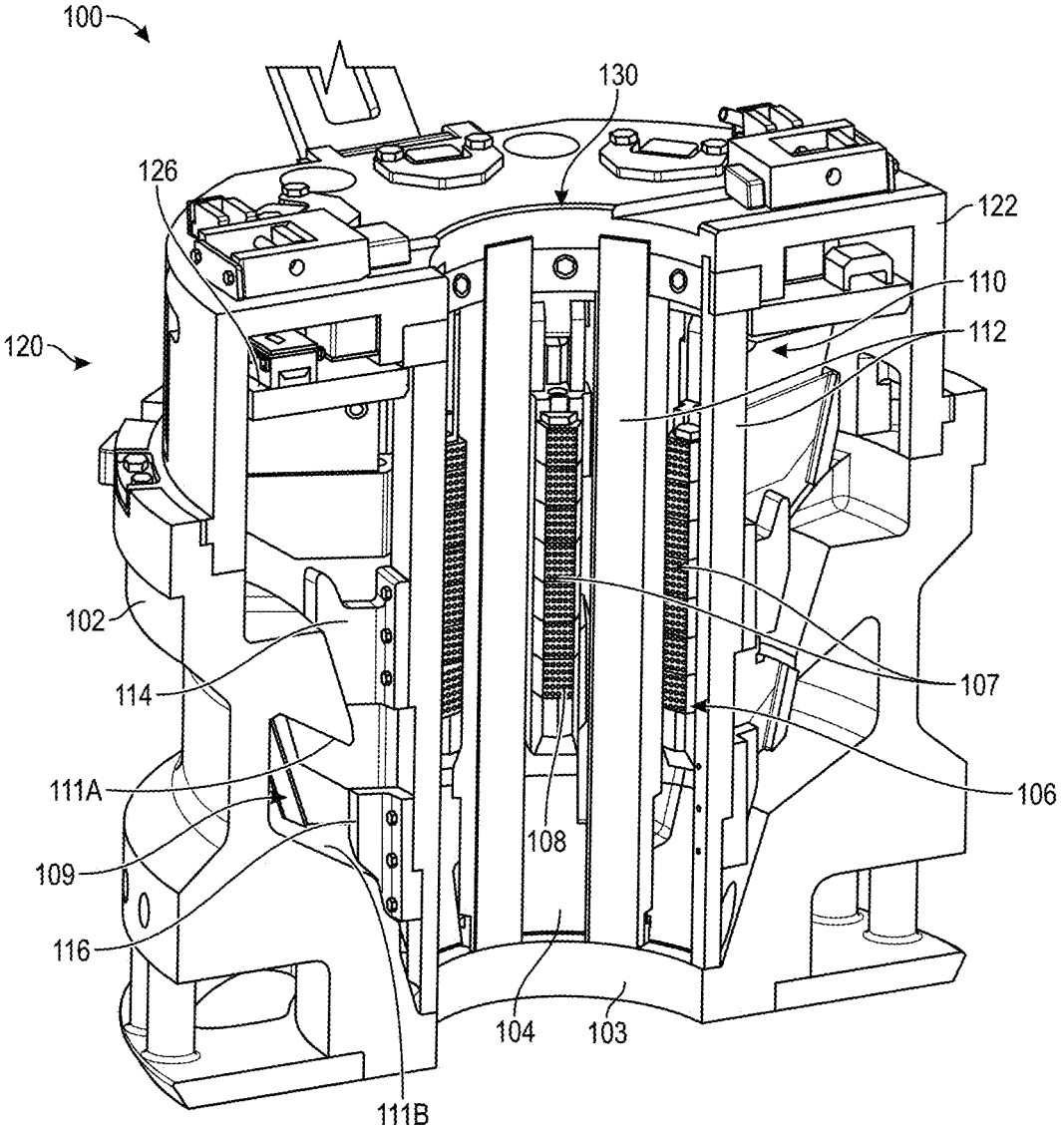
FIG. 4 illustrates a perspective, sectional view of the spider in a retracted position, according to an example.

FIG. 4 illustrates a perspective, sectional view of the spider 100 in a retracted position, according to an example. In this position, the slips 107 have moved outwards partially through the cage 110 and at least partially into the pocket 109. As compared to FIG. 1, it can be seen that the timing ring 126 has been driven upward, away from the spider body 102, and toward the top of the cover 122. This, in turn, drives the slips 107 upwards relative to the spider body 102 (and, specifically, the bowl 104). As such, the insert 108 is now at its farthest point away from the centerline of the spider 100 available and may be, for example, outward of at least a portion of the cage 110. Thus, in this position, the spider 100 provides maximum clearance therethrough, while the cage 110 provides a generally cylindrical guide through the spider body 102. Tools, tubulars, etc., that are run through the spider 100 (e.g., through the top opening 130) in this position may avoid colliding with or abrading against the inserts 108, the lifting assembly 120, or other internal components of the spider 100, as the cage 110 may prevent such contact.

Figure 5A:
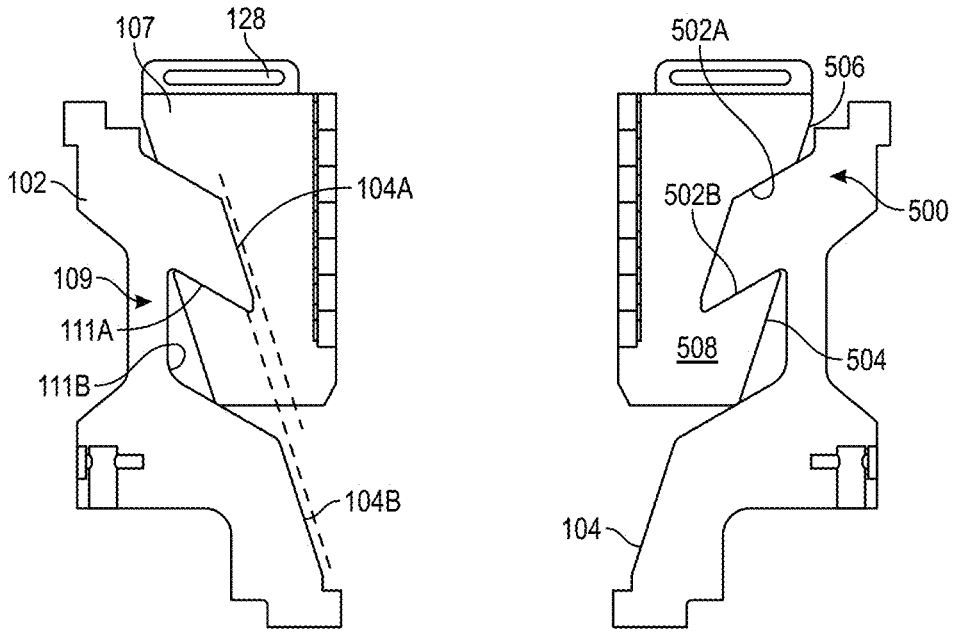
FIGS. 5A, 5B, and 5C illustrate a simplified, side view of the slips and a spider body of the spider, with the slips in a retracted position, an intermediate position, and an extended position, respectively, according to an example.
Figure 5B:
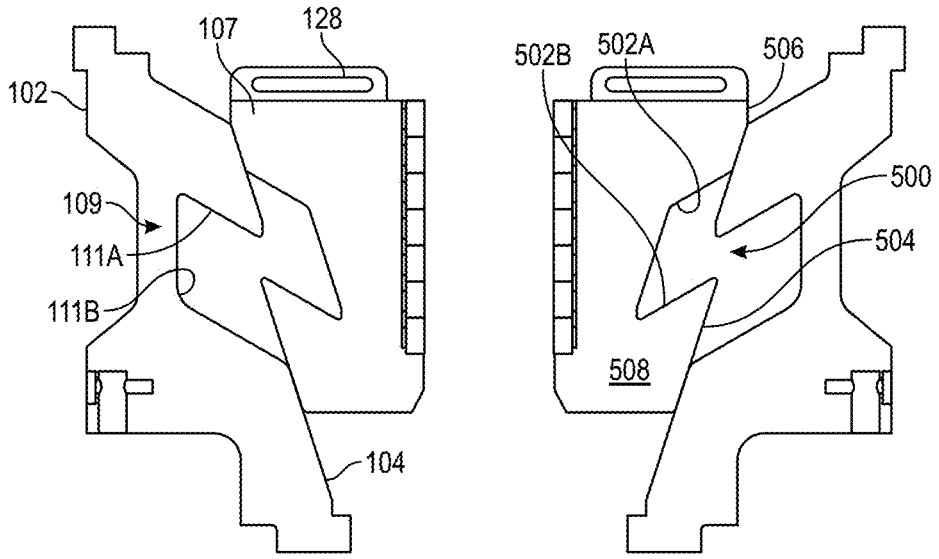
Figure 5C:
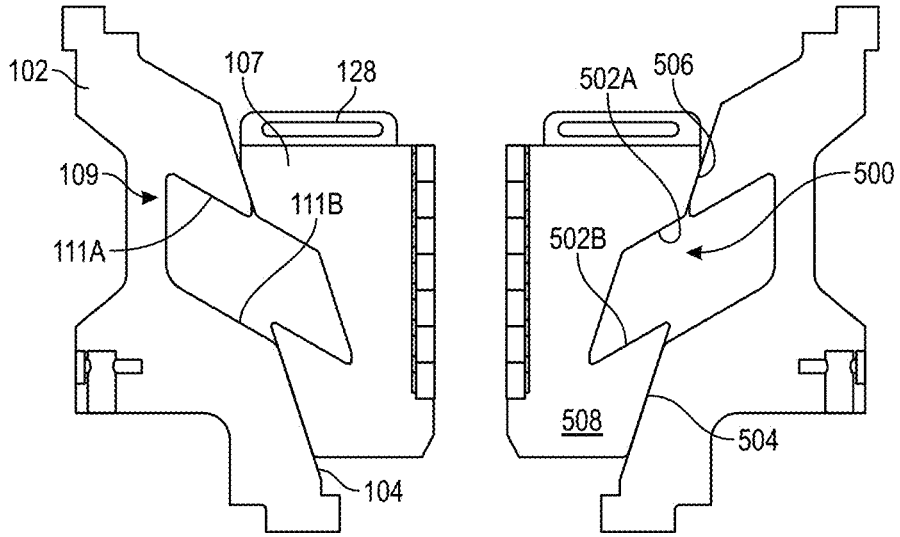

FIGS. 5A, 5B, and 5C illustrate simplified, side views of the slips 107 of the slips assembly 106 (e.g., FIG. 1) and the spider body 102, in the retracted position, an intermediate position, and an engaging position, respectively, according to an example. Referring to FIG. 5A, the slips 107 define a receiving cavity 500, as well as fast-tapered surfaces 502A, 502B. The slips 107 also define primary tapers 504, 506. The cavity 500 is defined, in this example, axially between the primary tapers 504, 506. The fast-tapered surfaces 502A, 502B each intersect a separate one of the primary tapers 504, 506.

In the retracted position of FIG. 5A (also shown in FIG. 1), the slips 107 are received at least partially into the pocket 109. Specifically, the pocket 109 has the fast-tapered surfaces 111A, 111B defining part of the pocket 109 (e.g., axial upper and lower walls thereof). A lower portion 508 of the slips 107 may be received into the pocket 109 and slide along the fast-tapered surface 111B until the fast-tapered surface 502B engages the fast-tapered surface 111A. This may serve as an upper end range for axial movement of the slips 107, and may secure the radial position, as well, as the fast-tapered surface 111B and the fast-tapered surface 502A may form an undercut engagement, as shown.

FIG. 5A also shows another feature of the tapered bowl 104, referring to the two dashed lines extending along upper and lower surfaces 104A, 104B thereof. The upper and lower surfaces 104A, 104B may be defined on either axial side of the pocket 109 and may extend axially therefrom. The upper and lower surfaces 104A, 104B may be offset with respect to one another. Accordingly, while, in some examples, the upper and lower surfaces 104A, 104B may extend at a generally constant angle, the lower surface 104B may be shifted radially inwards, as compared to a continuous trajectory defined by the upper surface 104A. This shifted position may facilitate the slips 107 being forced into the pocket 109 by upward axial movement. For example, the primary taper 504 may catch on the fast tapered surface 111A and be forced into the pocket 109 by upward movement of the slips 107, rather than being permitted to slide along the upper surface 104A.

Proceeding to FIG. 5B, by extending the actuators 124 (e.g., FIG. 1) the timing ring 126 (FIG. 1) and thus the slips 107 are pressed downwards relative to the spider body 102. The tapers of the spider body 102 and the slips 107, thus wedge the slips 107 radially inwards. The slips 107 are connected to the timing ring 126 (e.g., FIG. 1) by the slot 128, which permits the slips 107 to slide radially inwards while being driven downwards. The relatively large angle of the fast-tapered surfaces 111A, 111B results in a relatively large radial inward movement over a relatively short axial downward movement, as compared to movements along the main bowl 104. Thus, the slips 107 are driven out of the pocket 109 and into the intermediate position of FIG. 5B. In this position, the primary tapers 504, 506 engage and slide against the bowl 104.

Continued downward movement of the timing ring 126 connected to the slips 107 causes the primary tapers 504, 506 of the slips 107 slide along the bowl 104, which is complementarily tapered, as mentioned above. Further, the slot 128 connection with the timing ring 126 continues to permit radially-inward movement of the slips 107. Accordingly, the slips 107 slide both axially downwards and radially inwards. The relatively small taper angle of the bowl 104, as compared to the fast-tapered surfaces 111A, 111B of the pocket 109, results in the downward travel causing proportionally less radial inward movement, as proceeding from the intermediate position of FIG. 5B to the engaging position of FIG. 5C.

In the engaging position of FIG. 5C, the slips 107 have been pressed axially downward to extend radially inward. In some examples, the illustrated position may represent a fully extended position, but in others, the slips 107 may be configured to slide further in the bowl 104. However, the engaging position of the slips 107, in general, may be any position in which the primary tapers 504, 506 engage (e.g., slide on) the bowl 104 (above and below the pocket 109), such that the slips 107 are engageable with a variety of different sizes of tubulars.

Figure 6:
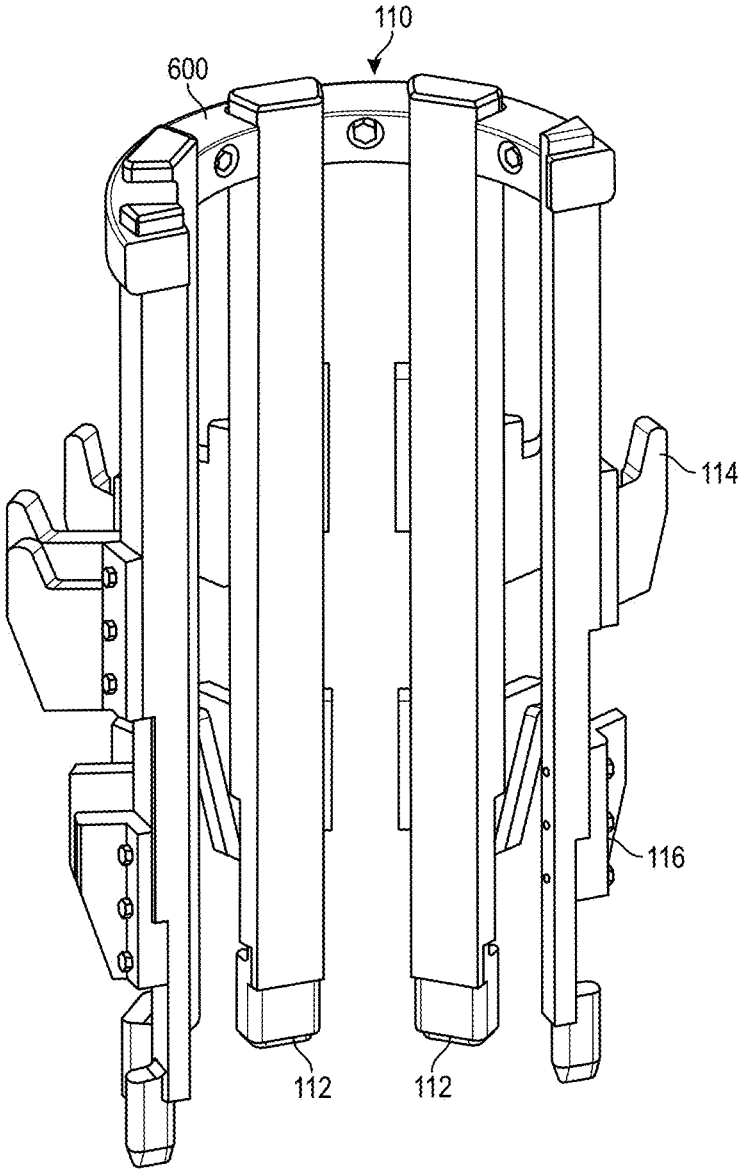
FIG. 6 illustrates a perspective, sectional view of a cage of the spider, according to an example.
Figure 7:
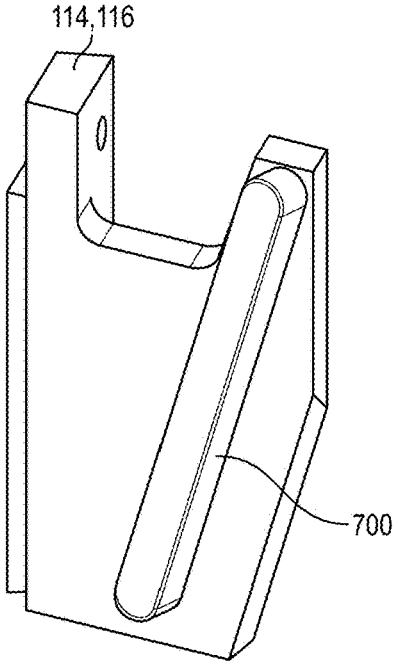
FIG. 7 illustrates a perspective view of a slips guide of the spider, according to an example.

FIG. 6 illustrates a perspective, sectional view of the cage 110, according to an example. As shown, the cage 110 includes the bars 112 and the guide members 114, 116 coupled thereto. The cage 110 may also include an upper ring 600 that may connect the upper axial extents of the bars 112 together. The lower axial extents of the bars 112 may be secured directly to the spider body 102 (e.g., FIG. 1) or a lower ring in some examples. Circumferentially adjacent bars 112 may guide the individual slips 107 along at least a portion of their movement between the engaging and retracted positions discussed above. In particular, each bar 112 may be connected to two each of the guide members 114, 116. As shown in FIG. 7, each guide member 114, 116 may include a guide feature 700 (e.g., a rail). The guide feature 700 may be received into a groove formed in the slips 107, as will be discussed in greater detail below, to restrict the movement of the slips 107, so as to translate the axial movement of the timing ring 126 into radial movement of the slips 107.

Figure 8:
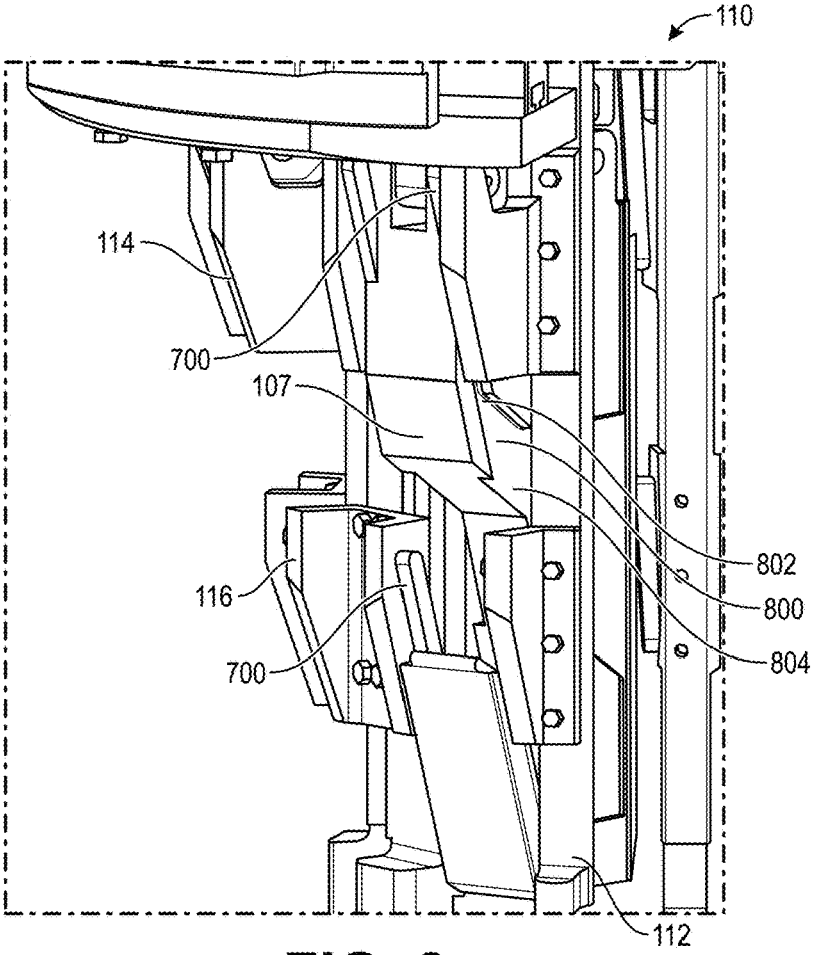
FIG. 8 illustrates a perspective view of the slips engaging the slips guide members and extending through the cage, according to an example.

FIG. 8 illustrates another perspective view of a section of the cage 110, the guide members 114, 116, and one of the slips 107, according to an example. In this view, grooves 800 are visible on one circumferential side of the slip 107. A mirror image of the visible groove 800 may be formed in the other circumferential side of the slip 107. Further, a continuous and/or two or more of the grooves 800 may be provided near the top and bottom of the slip 107, so as to engage with guide features (e.g., rails) 700 of the upper and lower guide members 114, 116.

The grooves 800 may be configured to receive the guide features 700 of the guide members 114, 116, as shown. The grooves 800 may thus be shaped to permit travel of the slip 107 relative to the guide members 114, 116, particularly the guide feature 700 thereof. For example, a first portion 802 of the groove 800 may correspond to travel that is along the orientation of the elongated guide feature 700 (e.g., generally narrow), and a second portion 804 may correspond to travel that is primarily lateral to the guide feature 700. The guide feature 700 may be received in the first portion 802 when the slips 107 are traveling between the intermediate position and the engaging position (e.g., along the bowl 104 of FIG. 1), while the guide feature 700 may be received in the second portion when the slips 107 are traveling between the intermediate position and the retracted position (e.g., into/out of the pocket 109 of FIG. 1).

The combination of the guide feature 700, the grooves 800, and the geometry of the timing ring 126 and the surfaces of the spider body 102 may result in the simultaneous axial and radial movement of the slips assembly 106, e.g., without requiring springs or other biasing members.

Figure 9B:
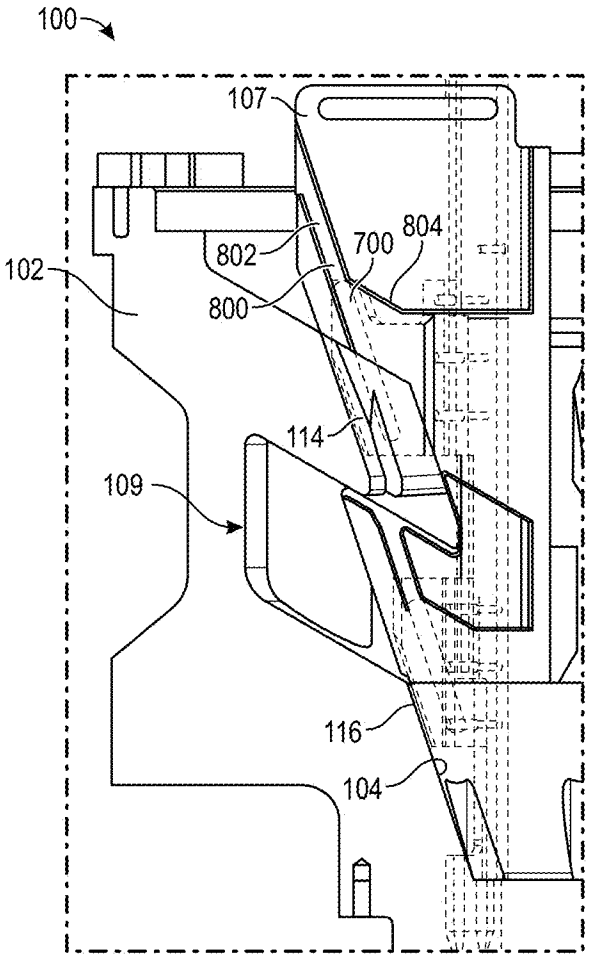
FIGS. 9A and 9B illustrate side, perspective views of the slips in the retracted and intermediate positions, respectively, showing the slips sliding along the slips guides and through the cage, according to an example.
Figure 9A:
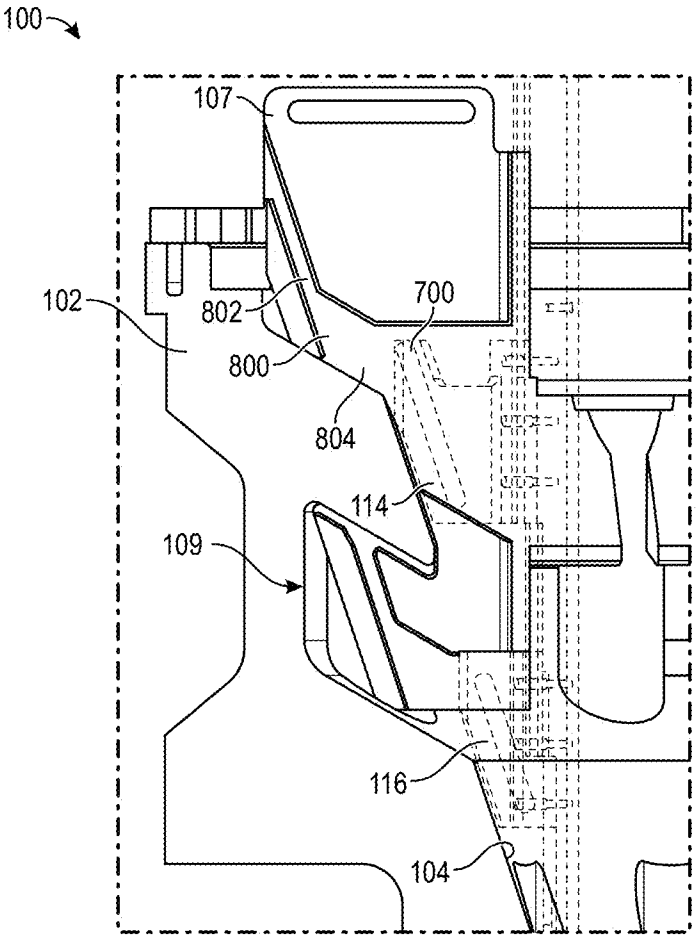

FIGS. 9A and 9B illustrate side, sectional views of the spider 100, showing the cage 110 as translucent for purposes of illustration, according to an example. FIG. 9A shows the slip 107 in a retracted position, and FIG. 9B shows the slip 107 in an intermediate position. As can be seen, the guide features 700 of the upper and lower guide members 114, 116 are received into the first portion 802 of the groove 800 when the slips 107 move from the retracted position (in the pocket 109, as shown in FIG. 9A) toward the intermediate position (FIG. 9B). As shown specifically in FIG. 9A, the guide feature 700 slides against the slip 107, between the second portions 804 of the two grooves 800 therein, which facilitates the primarily radial movement of the slip 107 relative to the pocket 109, driven by axial movement of the timing ring 126 (e.g., FIG. 1).

Figure 10:
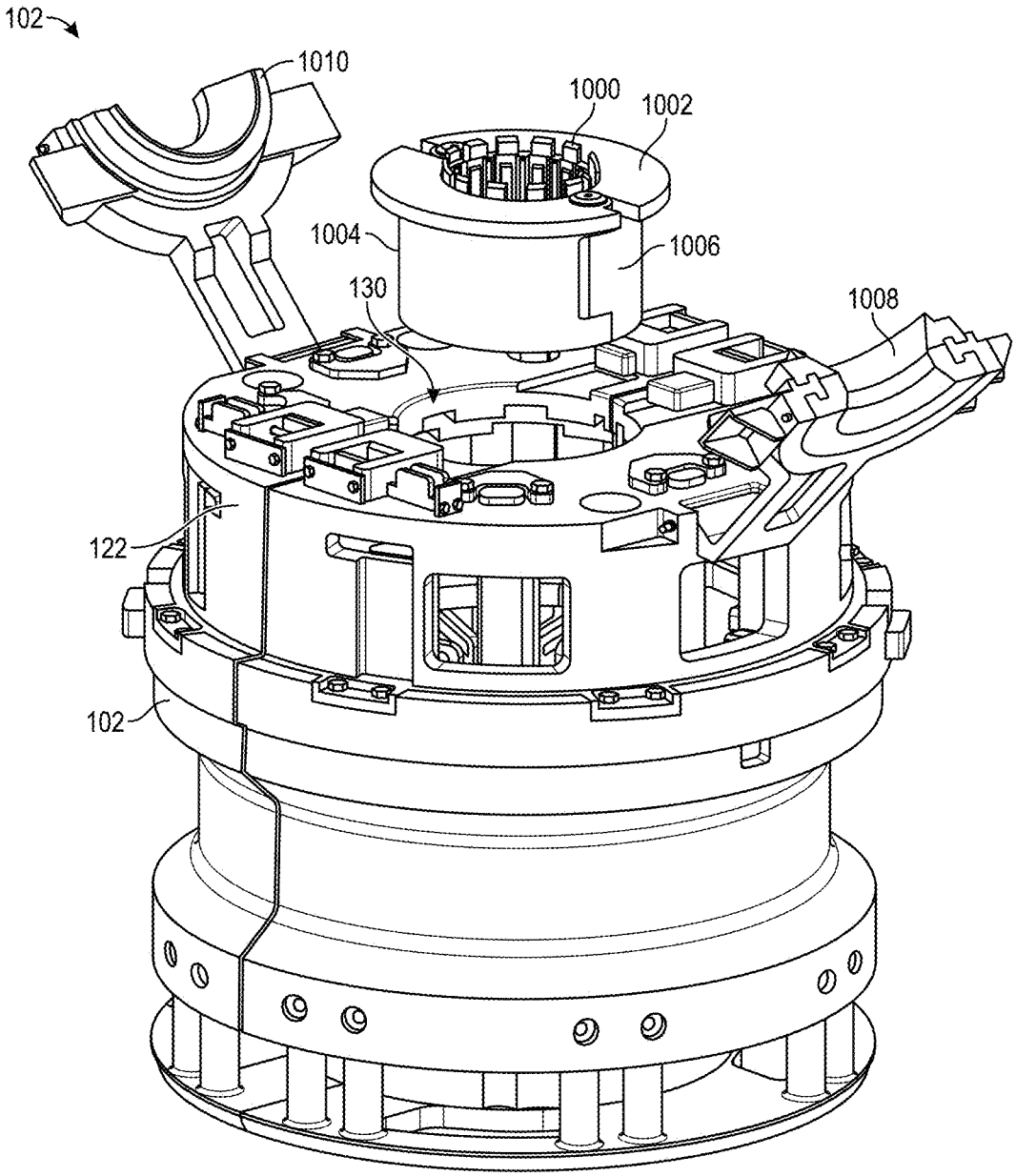
FIG. 10 illustrates a perspective view of an adapter bushing that is positionable within and supportable on the spider for engaging smaller-diameter pipe than the slips can reach, according to an example.

FIG. 10 illustrates a perspective view of the spider 100 with an adapter bushing 1000 being inserted into the top opening 130, according to an example. As shown, the adapter bushing 1000, which may include a shoulder, slips, or any other tubular engaging structure, may be received into the top opening 130, thereby substantially avoiding a large increase in height of the spider 100. The adapter bushing 1000 may include a main body 1001 and a flange 1002 that extends outward from the main body 1001 and may set against the top of the cover 122 and be supported thereby. The adapter bushing 1000 may further include two or more arcuate body sections 1004, 1006, which may be hinged, pinned, or otherwise connected together and positioned around a tubular.

In some examples, the spider 100 may include a tube guide, which may be formed of two or more arcuate members 1008, 1010 that are connected to the cover 122 via arms 1012. The tube guide may be removed (e.g., rotated away from) the top opening 130, as shown, to permit access for the adapter bushing 1000 into the top opening 130.

The adapter bushing 1000 may be particularly useful for converting a spider 100 configured for casing to be used with smaller-diameter drill pipe. Such drill pipe may be too small in diameter to be gripped by the slips assembly 106 (e.g., FIG. 1). The adapter bushing 1000 may thus be quickly received into place in the top opening 130, avoiding having to switch out the spider 100 with another component to work with the drill pipe.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for supporting an oilfield tubular, the apparatus comprising:

a body defining a tapered bowl and a pocket;

a cage extending axially through the body, wherein guides are attached to the cage;

a slips assembly comprising slips configured to engage the oilfield tubular received in the body, wherein the slips extend radially through the cage and engage the guides, the slips being movable between a retracted position in which the slips are received at least partially within the pocket and an extended position in which the slips slide against the tapered bowl; and a lifting assembly coupled to the slips and configured to apply a linear, axially-directed force to the slips, wherein the guides cause the slips to move radially and axially in response to the linear, axially-directed force.

2. The apparatus of claim 1, wherein the body defines two or more fast-tapered surfaces that intersect the tapered bowl, wherein the slips each comprise two or more fast-tapered surfaces configured to engage the fast-tapered surfaces of the body, and wherein the slips each comprise a primary tapered surface configured to engage the tapered bowl.

3. The apparatus of claim 1, wherein the slips each comprise a groove configured to receive a guide feature of at least one of the guides, and wherein the guide feature received into the groove constrains movement of the slips.

4. The apparatus of claim 3, wherein the groove has a first portion that facilitates movement of the slips along the tapered bowl, and a second portion that facilitates movement of the slips primarily radially into the pocket.

5. The apparatus of claim 3, wherein the guide feature comprises an elongated ridge, and wherein the elongated ridge constrains movement of the slip relative to the guide feature.

6. The apparatus of claim 1, wherein the cage comprises a plurality of axially-extending rails disposed at angular intervals, and wherein the slips are positioned between circumferentially adjacent rails of the plurality of axially-extending rails.

7. The apparatus of claim 1, wherein the lifting assembly comprises a plurality of cylinders coupled to a timing ring that is connected to the slips, and wherein the cylinders are configured to press the timing ring toward the body by extending.

8. The apparatus of claim 7, wherein the cylinders extend through the timing ring and are configured to pull the timing ring away from the body by compressing.

9. The apparatus of claim 7, wherein the cylinders are at least partially received into the body and through the timing ring.

10. The apparatus of claim 7, wherein the lifting assembly further comprises a cover coupled to the body and defining a top opening therethrough, and wherein the cylinders are coupled to the cover, such that extending the cylinders drives the timing ring away from the cover.

11. The apparatus of claim 7, wherein the slips are coupled to the timing ring via a radially-extending slot.

12. The apparatus of claim 1, further comprising an adapter bushing, wherein the lifting assembly further comprises a cover coupled to the body and defining a top opening therethrough, and wherein the adapter bushing is receivable at least partially into the top opening and within the cage.

13. The apparatus of claim 1, wherein the tapered bowl extends on either axial side of the pocket.

14. The apparatus of claim 1, wherein the slips engage with the body in the pocket to prevent upward movement of the slips in the retracted position.

15. The apparatus of claim 1, wherein the slips in the retracted position do not extend radially inward of the cage.

16. An apparatus for supporting an oilfield tubular, the apparatus comprising:

a body defining a tapered bowl and a pocket, wherein the body defines two or more fast-tapered surfaces that intersect the tapered bowl;

a cage extending axially through the body, wherein the cage comprises a plurality of axially-extending rails disposed at angular intervals, and wherein a plurality of guides are attached to the cage;

a slips assembly comprising a plurality of slips configured to engage the oilfield tubular when the oilfield tubular is received in the body, wherein the slips extend radially through the cage and engage the guides, wherein the slips are positioned between circumferentially adjacent rails of the plurality of axially-extending rails, wherein the slips are movable between a retracted position in which the slips are received at least partially within the pocket and an extended position in which the slips slide against the tapered bowl, wherein the slips each define a groove configured to receive a guide feature of at least one of the guides, wherein the guide feature received into the groove constrains movement of the slips, wherein the groove has a first portion that facilitates movement of the slips along the tapered bowl, and a second portion that facilitates movement of the slips primarily radially into the pocket, and wherein the slips each comprise:

two or more fast-tapered surfaces configured to engage the fast-tapered surfaces of the body; and a primary tapered surface configured to engage the tapered bowl;

a lifting assembly coupled to the slips and configured to apply a linear, axially-directed force to the slips, wherein the guides cause the slips to move radially and axially in response to the linear, axially-directed force, and wherein the lifting assembly comprises:

a plurality of cylinders coupled to a timing ring that is connected to the slips, wherein the slips are coupled to the timing ring via a radially-extending slot, wherein the cylinders are at least partially received into the body and through the timing ring, wherein the cylinders are configured to press the timing ring toward the body by extending, and wherein the cylinders extend through the timing ring and are configured to pull the timing ring away from the body by compressing; and a cover coupled to the body and defining a top opening therethrough, wherein the cylinders are coupled to the cover, such that extending the cylinders drives the timing ring away from the cover.

17. A method for supporting an oilfield tubular, the method comprising:

receiving the oilfield tubular into a body, wherein the body defines a tapered bowl and a pocket, wherein a cage extends axially through the body, and wherein guides are attached to the cage;

engaging the oilfield tubular with a slips assembly, wherein the slips assembly comprises slips that extend radially through the cage and engage the guides;

actuating the slips between a retracted position and an extended position, wherein the slips are received at least partially within the pocket in the retracted position, and wherein the slips slide against the tapered bowl in the extended position; and applying a linear, axially-directed force to the slips using a lifting assembly, wherein the lifting assembly is coupled to the slips, and wherein the guides cause the slips to move radially and axially in response to the linear, axially-directed force.

18. The method of claim 17, further comprising engaging fast-tapered surfaces of the body with two or more fast-tapered surfaces of the slips.

19. The method of claim 17, further comprising engaging the tapered bowl with a primary tapered surface of the slips.

20. The method of claim 17, further comprising receiving a guide feature of at least one of the guides into a groove in at least one of the slips, which constrains movement of the slips, wherein the groove has a first portion that facilitates movement of the slips along the tapered bowl, and a second portion that facilitates movement of the slips primarily radially into the pocket.

* * * * *